US005122093A

United States Patent [19]

Perkitny

[11] Patent Number: 5,122,093

[45] Date of Patent: Jun. 16, 1992

[54] COIN BANK

[75] Inventor: Jerzy Perkitny, Bay Village, Ohio

[73] Assignee: Mag-Nif, Inc., Mentor, Ohio

[21] Appl. No.: 635,928

[22] Filed: Dec. 28, 1990

[51] Int. Cl.[5] ..... G07D 3/04

[52] U.S. Cl. ..... 453/13; 446/9

[58] Field of Search ..... 453/9, 12, 13, 14, 15, 453/3; 446/9, 10, 11, 13; 194/241, 242

[56] References Cited

U.S. PATENT DOCUMENTS

| | | | |
|---|---|---|---|
| 847,438 | 3/1907 | Ralston | 453/15 |
| 1,416,120 | 5/1922 | Paul | 453/8 |
| 3,299,899 | 1/1967 | Nadherny | 453/12 |
| 4,607,648 | 8/1986 | Hough | 453/9 |

*Primary Examiner*—F. J. Bartuska

*Attorney, Agent, or Firm*—Watts, Hoffmann, Fisher & Heinke

[57] ABSTRACT

A coin bank for sorting and storing coins of various sizes is disclosed. The coin bank includes a coin receiver, a plurality of coin channels, a plurality of coin sorting apertures, a coin storage structure and a tilt motion mechanism. The tilt motion mechanism tilts the channels from side to side to cause coins deposited in said receiver to roll along a serpentine coin path defined by the coin channels. Coins encounter sorting apertures along the path. When coins reach a aperture corresponding in size, they fall into a coin storage structure. The coin channels are transparent so the interesting visual effect of coins traversing the coin path may be observed.

20 Claims, 10 Drawing Sheets

COIN BANK

BACKGROUND OF THE INVENTION

1. Field of the Invention.

This invention relates to coin banks and more particularly to motorized coin banks having coin sorters.

2. Description of the Related Art.

Motorized coin banks which sort coins according to their denomination are sold as toys or novelties. Often, these banks flip or roll the coins as they are sorted. In some cases, levers and wheels are made to pivot or spin to create visual effects.

In one proposed motorized coin bank known by the name MONEY WORKS, coins are made to roll on edge in a steady spiral path. Coins encounter openings of varying sizes along the spiral path and fall out of the path at different locations to be sorted.

The present invention provides a new and useful motorized coin bank having a unique serpentine coin path producing a lengthy visual cascade effect as coins are sorted. In addition, the present invention employs a unique control mechanism for turning itself on and off at the appropriate times.

SUMMARY OF THE INVENTION

In a preferred an illustrated embodiment of the invention, a new coin bank for sorting and storing coins of varying diameters comprises: a base; a plurality of coin supporting channels; a coin receiver; a plurality of apertures of varying size; a tilt motion mechanism; and, a coin storage structure. The coin supporting channels form a coin path. The coin receiver receives coins to be sorted and communicates with a first of the channels at an upstream end of the path. Located along the coin path are the plurality of apertures of varying size where each permits passage of only coins having a diameter less than or equal to a predetermined diameter. The tilt motion mechanism is operable to rock the channels in a continuous tilting motion such that the channels are alternately inclined in one direction and then inclined in the opposite direction. The tilting motion causes a coin present in the receiver to roll on edge along the path from a first channel to successive downstream channels. The coin storage structure is located to catch coins which pass through the apertures.

The coin storage structure is divided into separate compartments. Each compartment is located beneath a particular aperture such that coins of only one size are deposited in each compartment.

The channels forming the coin path are arranged to form a serpentine path. The channels are transparent so coins may be observed traveling along the serpentine path from the front and rear of the bank. This arrangement produces an interesting long-lasting optical effect as the channels are tilted causing coins to be sorted and stored.

In the preferred an illustrated embodiment, the coin receiver includes a sensing device for sensing the presence of a coin. The sensing device operates to control the tilt motion mechanism for rocking the channels. Thus, the coin bank is motionless until a coin is placed in the receiver. Once a coin's presence is sensed, the tilt motion mechanism tilts the channels causing the coin to roll on edge. Absence of a coin begins a process whereby a switching mechanism counts the number of tilts produced by the tilt motion mechanism. After a predetermined number of tilts, the tilt motion mechanism is turned off. This way, a coin has time to travel the full length of the coin path before the tilting motion ceases.

The preferred coin bank includes coin stop structure extending into the coin path adjacent the apertures. The coin stop structure engages and stops selected ones of passing coins which are smaller than a predetermined size. The coin stop structure facilitates passage of the selected coins through the apertures. The coin stop structure does not interfere with the passage of larger coins due to cams which are placed about each aperture. The cams urge passing coins away from the stop structure if the passing coins are greater than a predetermined size.

The coin receiver of the preferred coin bank is a hopper which may accept numerous coins of random sizes. The hopper includes an ejector finger which reciprocates to urge a coin towards the first channel. The ejector finger is connected to the tilt motion mechanism to reciprocate in synchronism with the tilting of the channels.

DESCRIPTION OF THE PREFERRED EMBODIMENT

Figure 1:
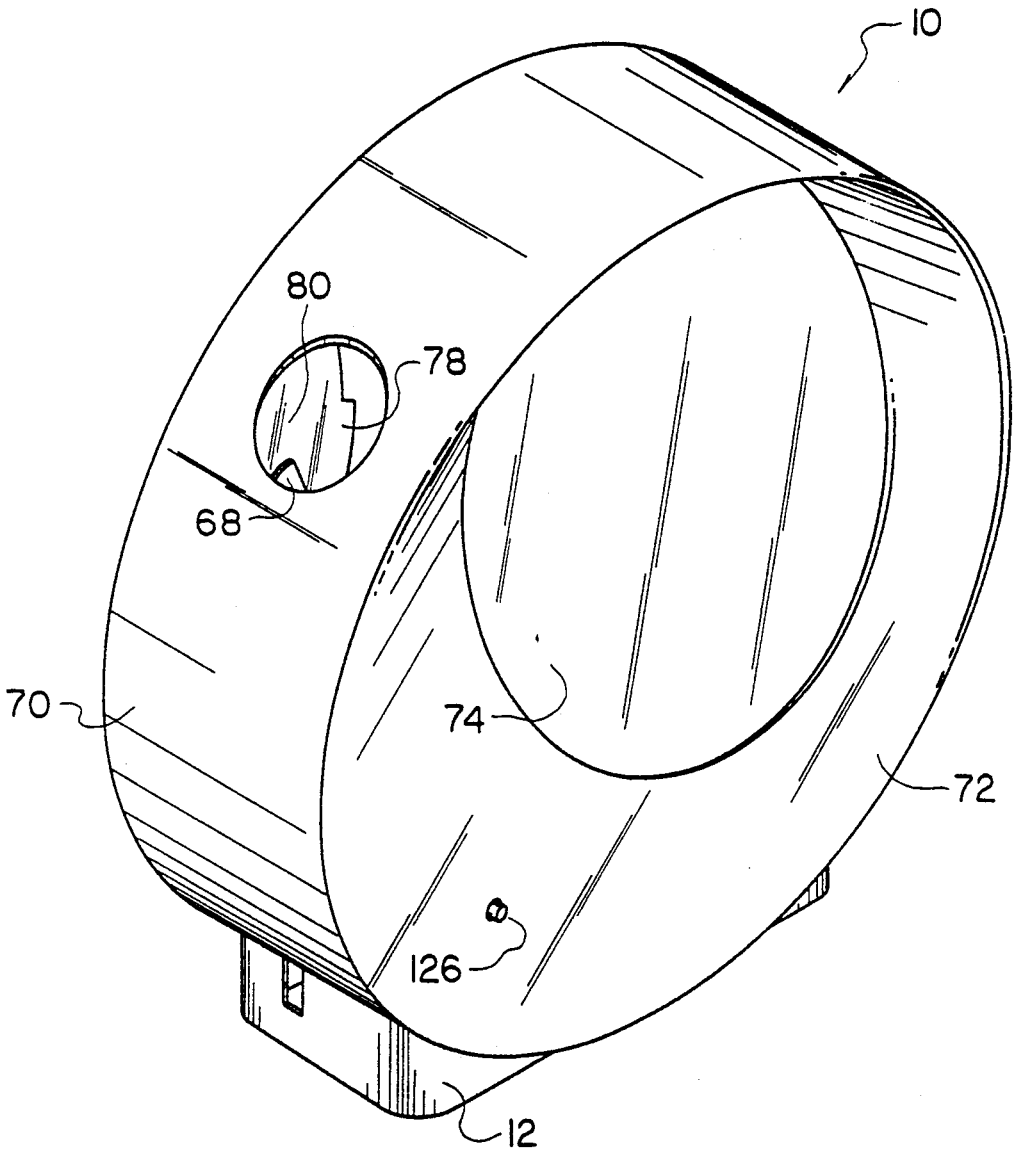
FIG. 1 is a perspective view of a coin bank constructed in accordance with the preferred embodiment of the invention.

A coin bank 10 embodying the present invention is illustrated in FIG. 1. The new coin bank 10 comprises: a base 12; a plurality of coin supporting channels 14,16,18,20 defining a coin path 22; a coin receiver 24; a plurality of apertures 26,28,30,32 of varying size; a tilt motion mechanism 34; and a coin storage structure 36. The coin receiver 24 communicates with a first of the coin channels 14. The tilt motion mechanism 34 is operable to rock the channels 14,16,18,20 in a continuous tilting motion such that the channels are alternately inclined in one direction and then in the opposite direction. The tilting motion causes coins present in the receiver or along the path to roll along the path 22 from a first channel 14 to successive downstream channels. All coins eventually pass through the sorting apertures 26,28,30,32 at various locations along the path 22 depending on their size and into the coin storage structure 36.

The base 12 supports the bank 10 and includes a flat bottom 38 for resting on a flat surface such as a table. The base 12 includes part of a main pivot bearing 40 for pivotally supporting moving parts of the bank such as the channels 14,16,18,20. The base 12 of the preferred and illustrated coin bank 10 contains the tilt motion mechanism 34 and a battery 42.

Each channel 14,16,18,20 is defined by a coin ramp 44 and a sorter wall 46. The channels 14,16,18,20 are generally horizontally oriented and spaced vertically from one another. Coins are supported by the channels upright on edge but slightly tilted towards the rear of the bank. The coin ramps 44 contact the outer edges of coins and the sorter wall 46 contacts the faces of coins. Coins roll along the channels 14,16,18,20 under the influence of gravity in a downstream direction when the channels 14,16,18,20 are tilted by the tilt motion mechanism 34. The downstream end of each ramp 44 terminates at a vertical passage 50 such that coins may drop from upper channels to lower channels. Each half-cycle or tilt of the tilt motion mechanism 34 is timed to permit a coin to travel the full length of a channel 14,16,18,20.

The coin path 22 is defined by the channels 14,16,18,20. Located along the coin path 22 are the coin sorting apertures 26,28,30,32. The coin path 22 is serpentine due to the arrangement of the spaced channels 14,16,18,20. Coins present on the first channel 14 travel in a direction substantially opposite to a direction taken by coins present on the second lower channel 16.

Figure 10:
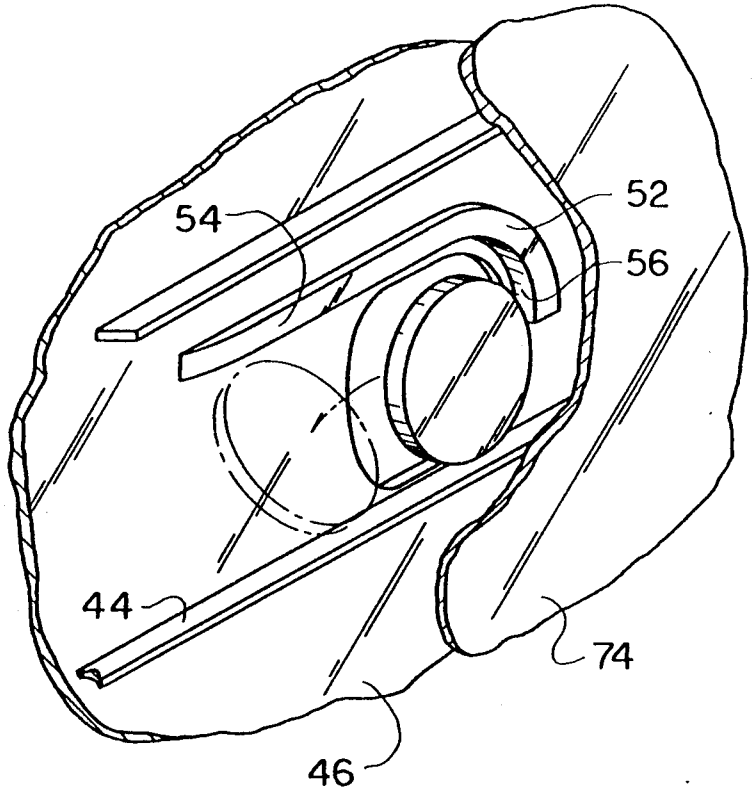
FIG. 10 is a perspective view of a coin sorting aperture.

Formed in the sorter wall 46 along the coin path 22 are the sorter apertures 26,28,30,32. The sorter apertures are arranged in order of increasing size from smaller to larger with the smallest aperture 26 being located upstream of the others and the largest aperture 32 being downstream of the others. As the coins travel along the coin path 22, a portion of one face of each coin is in sliding contact with the sorter wall 46. The apertures 26,28,30,32 are located to open the sorter wall 46 where the faces of coins of corresponding dimensions would contact it but for the aperture. When the coin encounters an aperture corresponding to its size, it leaves the coin path via the aperture and enters the coin storage structure 36 as seen in FIG. 10.

Though not required for successful operation, the preferred embodiment of the coin bank 10 includes an enhancement for improving the reliability of coin passage through the appropriate aperture 26,28,30,32. The sorter wall 46 includes coin stops 52 for halting downstream motion of coins along the coin path and coin cams 54 for deflecting coins greater than a predetermined size away from the stops 52. Each coin stop 52 forms a coin engaging surface 56 extending from the sorter wall 46 on the downstream side of each aperture 26,28,30,32. A coin's forward motion is halted as it engages the stop 52. The halted coin then tips through the aperture into the coin storage structure. The stops 52 facilitate passage of the coin through the apertures since they guarantee that a coin's forward momentum will not carry it beyond its corresponding aperture.

Figure 11:
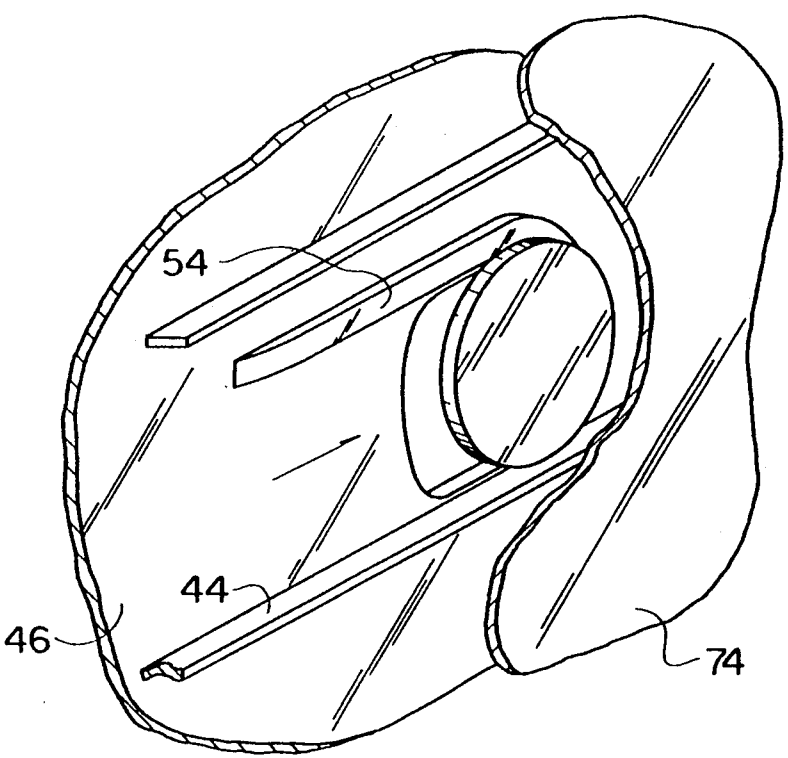
FIG. 11 is a perspective view of a coin sorting aperture.

Only selected coins are to be halted by the stops 52. Therefore coin cams 54 are provided adjacent all but the final aperture. The coin cams 54, like the coin stops 52, are formed by projections extending into the coin path from the sorter wall 46. The coin cams 54 are located a predetermined distance above the ramps 44 such that coins designated to pass through a given aperture 26,28,30,32 will pass beneath the associated coin cam 54. The sliding face of coins larger than the given aperture contact the face of the coin cam 54 and are urged away from the coin stops 52 to permit them to proceed downstream to their corresponding larger apertures as shown in FIG. 11.

The tilt motion mechanism 34 may comprise any of a number of conventional mechanisms which produce back and forth motion. The preferred and illustrated tilt motion mechanism 34 comprises a motor 58, a speed reducer 60 connected to the motor output, a gear 62 connected to the speed reducer output, and a drive cam 64 mounted eccentrically on the gear 62. A linear groove 66 is formed in a portion of the bank which is linked to the channels 14,16,18,20. The drive cam 64 fits slidably within the groove 66. As the gear 62 rotates, the eccentrically mounted drive cam 64 pushes on the walls of the groove 66 upward and downward in a cyclic fashion. The groove 66 and the drive cam 64 are spaced from the main pivot bearing 40. The cyclic motion is employed to incline the channels 14,16,18,20, to provide motion for an ejector finger 68 and for other purposes to be described. The speed ratio of the speed reducer 60 is chosen to produce a predetermined cycle frequency. The period of each cycle is chosen to permit a coin to travel the full length of a channel 14,16,18,20 and to drop down to the next lower channel before the channels reverse and tilt in the opposite direction.

Figure 2:
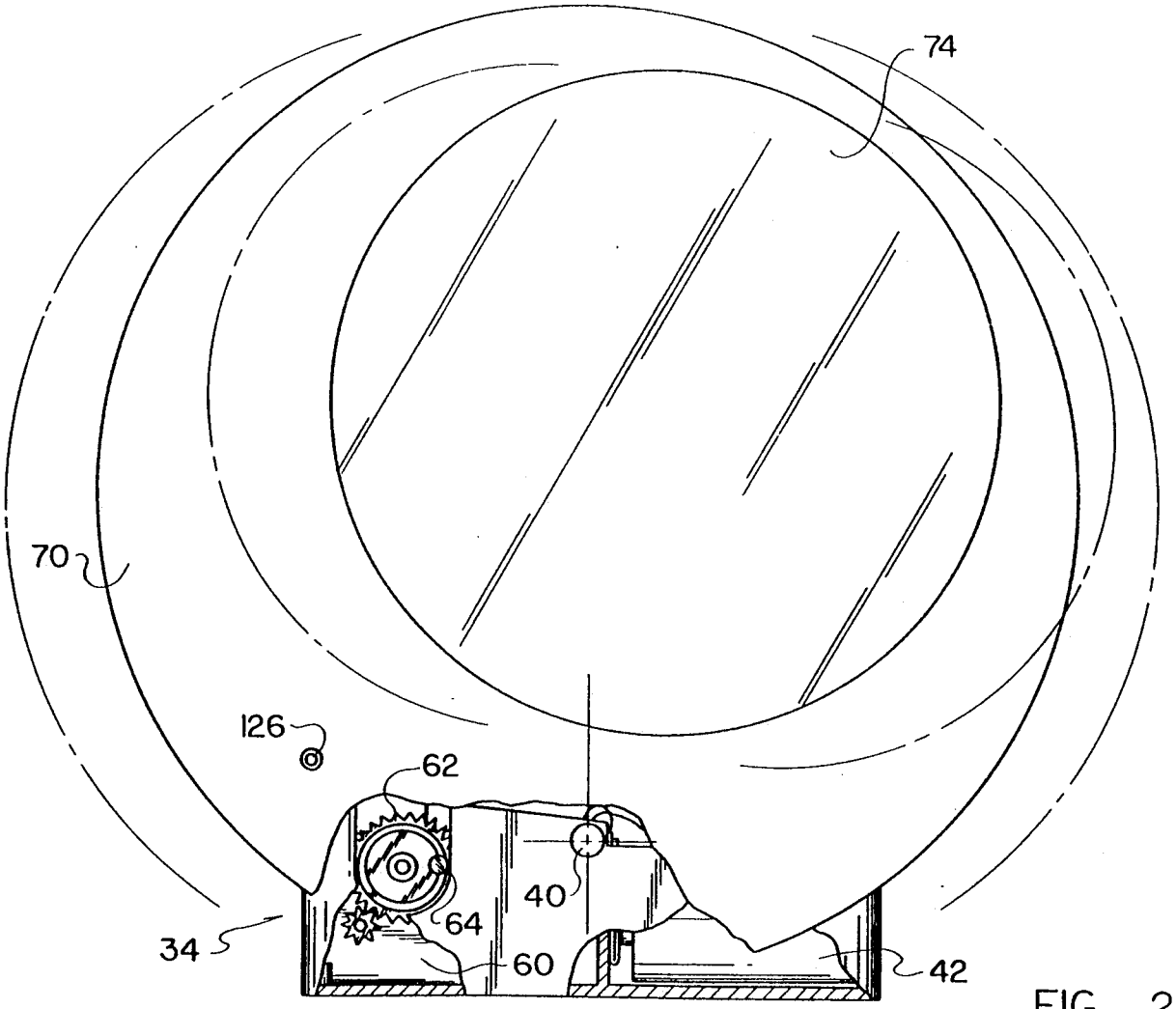
FIG. 2 is a front elevational view of the coin bank of FIG. 1 in motion with parts cut away.
Figure 3:
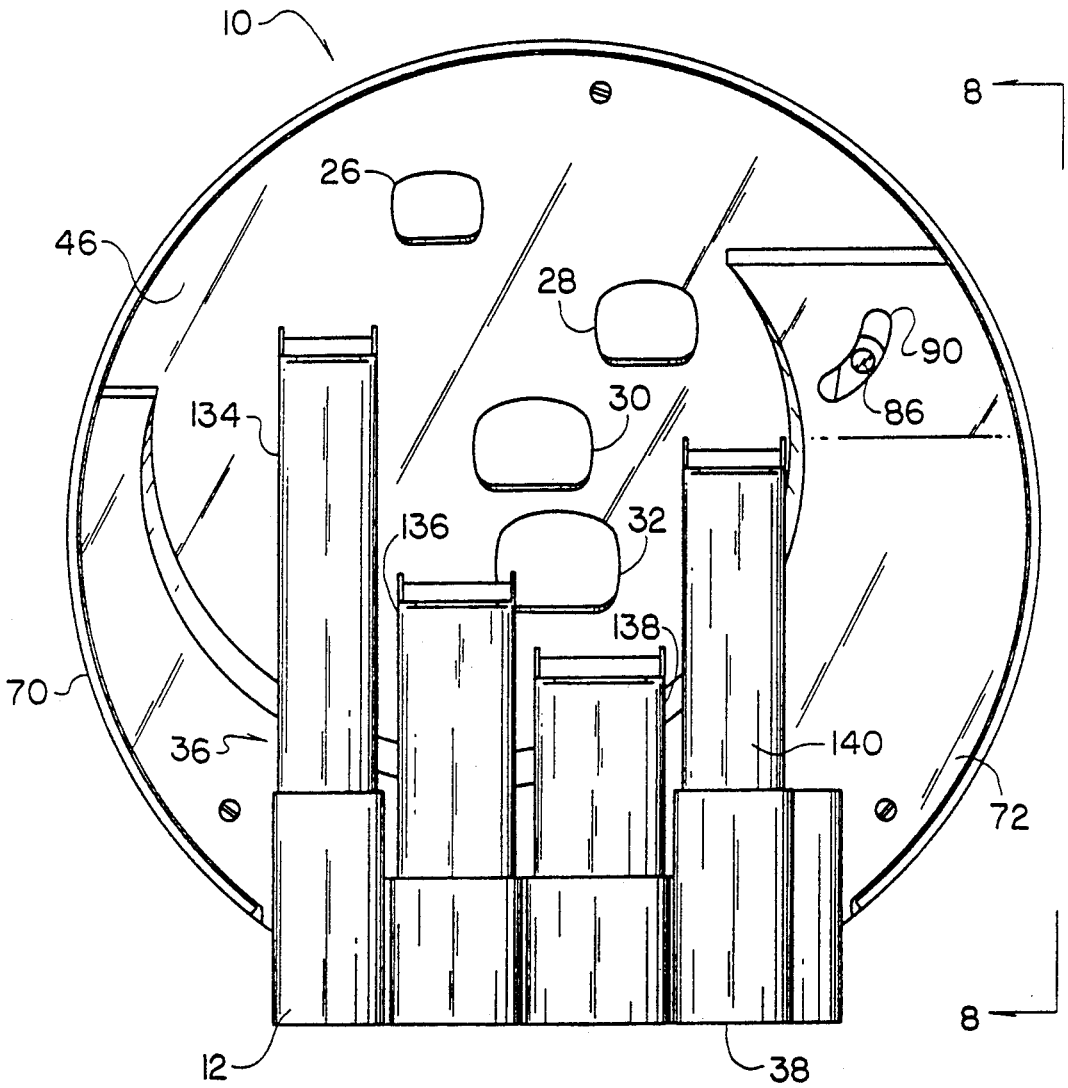
FIG. 3 is a rear elevational view of the coin bank of FIG. 1.

In the preferred and illustrated coin bank, a body 70 comprises the sorter wall 46, the channels 14,16,18,20, the receiver 24, and a shell 72. The body 70 is joined to the base 12 at the main pivot bearing 40. The groove 66 is formed in the body 70 at a point offset from the main pivot bearing 40. As illustrated in FIG. 2, the entire body 70 is tilted by the tilt motion mechanism 34.

The shell 72 of the body includes a transparent window 74 located in front of the coin channels 14,16,18,20. In the preferred embodiment, the entire shell 72 is made of transparent plastic so the inner workings may be observed.

The coin receiver 24 is adapted to receive coins from the user of the bank. The coin receiver 24 may be a simple slot directing coins to a first of the channels. The coin receiver 24 of the preferred and illustrated embodiment however allows a number of stacked coins to be placed in the receiver 24. The coin receiver 24 comprises a hopper 76, the ejector finger 68, and a exit passage 78 communicating the hopper 76 with the first coin channel 14. A coin is separated from the stack and urged toward the first channel 14 by the ejector finger 68 at an appropriate point in the cycle of the tilting motion.

Figure 8:
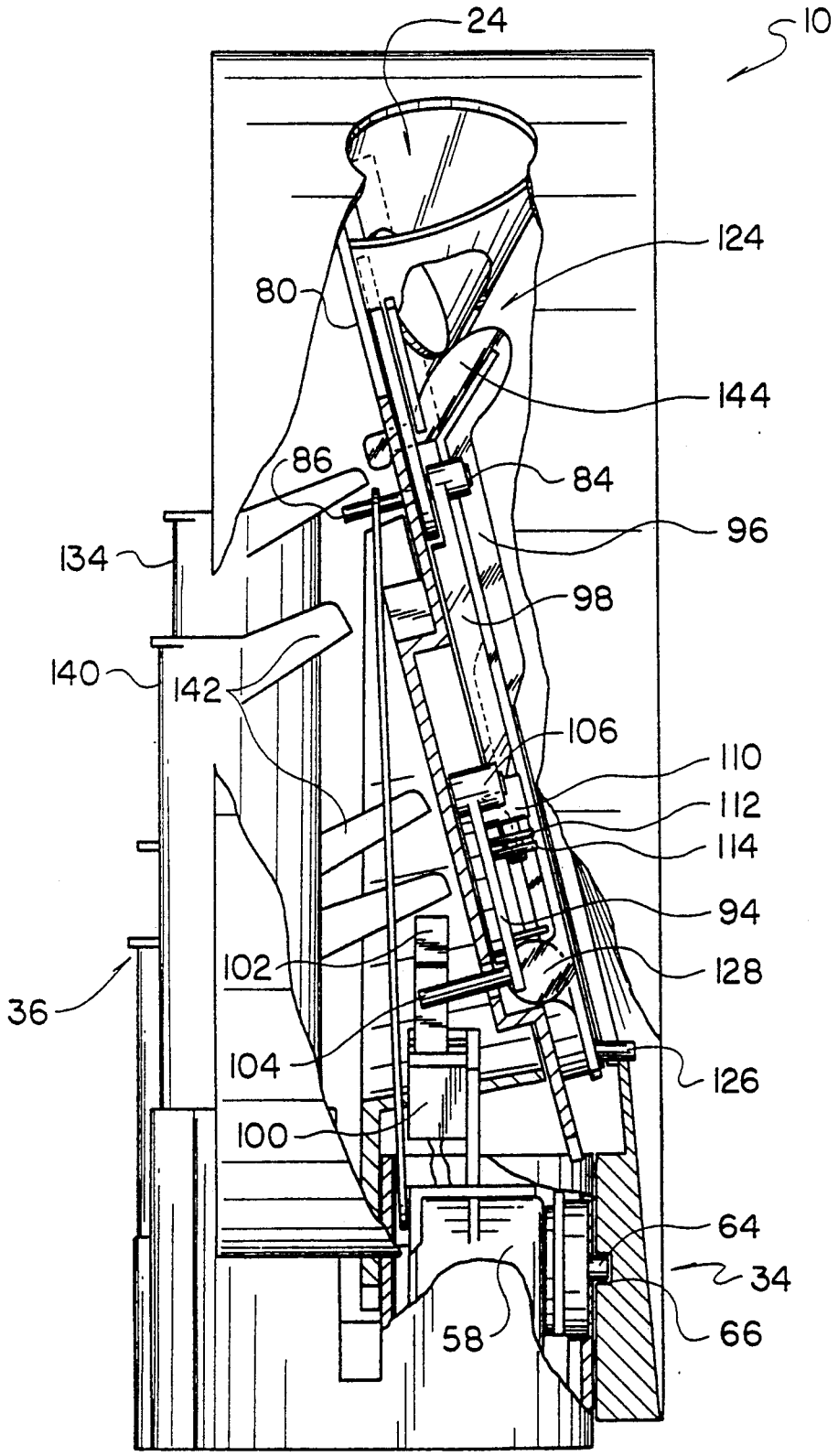
FIG. 8 is a side elevational view as seen approximately from the plane indicated by lines 8—8 of FIG. 3 with portions broken away.
Figure 9:
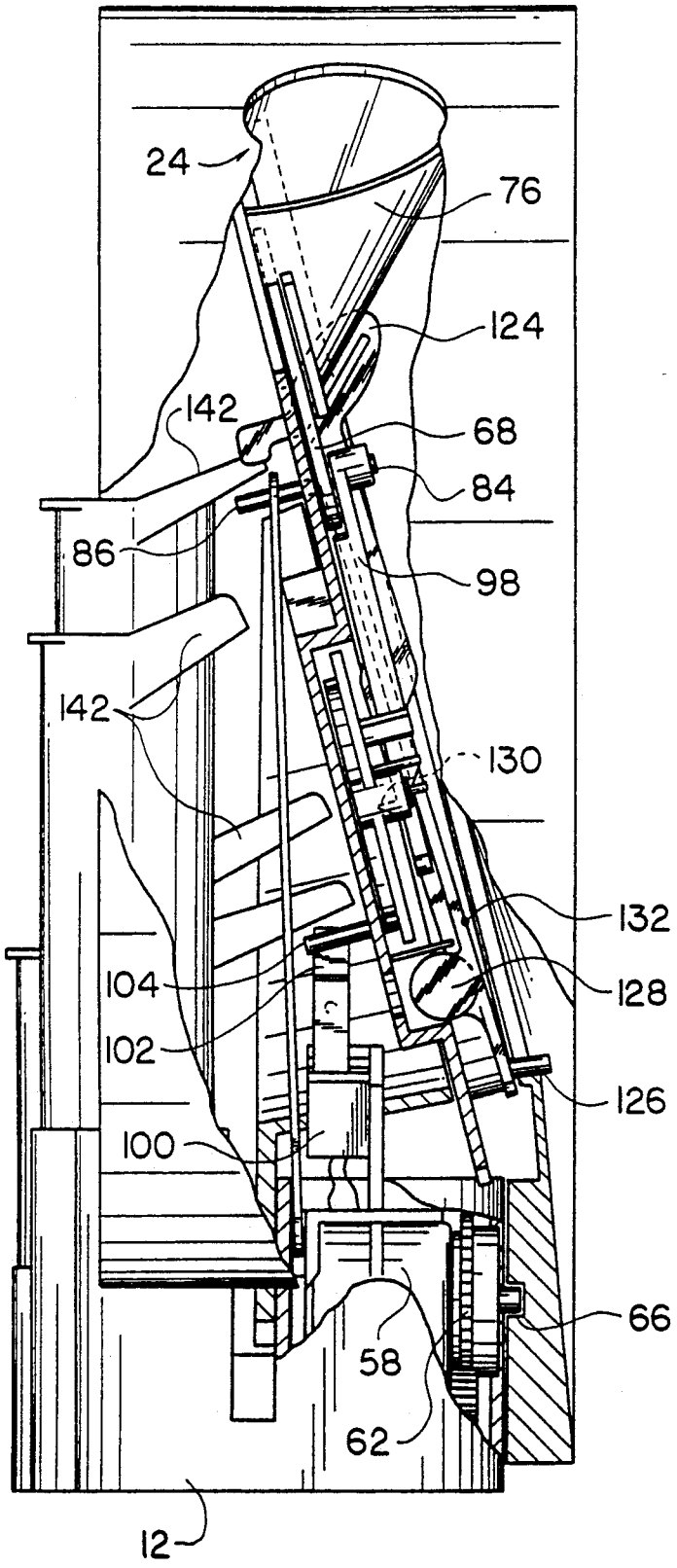
FIG. 9 is the view of FIG. 8 when the coin bank is switched off.

As illustrated in FIGS. 8 and 9, the hopper 76 takes the form of a truncated cylinder. The plane truncating the cylinder is defined by a hopper side wall 80. In the preferred and illustrated embodiment, one side of the hopper 76 is an extension of the sorter wall 46. Coins dropped in the hopper 76 naturally align themselves along the axis of the cylindrical hopper such that the planes of the coins are parallel to the plane of the hopper side wall 80. The lowermost coin of the stack, or a single coin in the hopper 76, is caused by gravity to lie flat against the hopper side wall 80. A coin lying against the hopper side wall 80 is aligned with an exit passage 82 of the hopper 76. The exit passage 82 is sized to be slightly wider than the thickest of coins to be sorted but not as wide as two of the thinnest of coins to be sorted.

Thus, two coins cannot pass through the exit passage 82 at once.

The ejector finger 68 is connected to the tilt motion mechanism 34 to reciprocate with respect to the hopper 76 in synchronism with the tilt of the channels 14,16,18,20. The preferred ejector finger 68 reciprocates in a plane which is parallel to the plane of hopper side wall 80 and the planes of the coins in the stack. The ejector finger 68 protrudes into the hopper 76 through a passage formed in the hopper opposite the exit passage 78 and is pivotally mounted to the body at a finger pivot bearing 84. The finger pivot bearing 84 follows the tilting motion imparted to the body 70. The ejector finger 68 includes a pin 86 projecting from its side. The pin 86 is pivotally connected to the upper end of a tie rod 88. The tie rod 88 is pivotally connected at its lower end to the stationary base 12. The tie rod 88 prevents the pin 86 from following the tilting motion of the finger pivot bearing 84 which moves with the body 70. The hopper 76 oscillates along a relatively large arc defined by the main pivot bearing 40. The ejector finger 68 is caused to oscillate with the same frequency about a relatively smaller arc defined by the pin 86 and the finger pivot bearing 84. With each cycle of the tilt motion mechanism 34, the ejector finger 68 reciprocates with respect to the hopper 76 to engage the edge of the lowermost coin in the hopper and urge the coin through the exit passage 82 towards the first channel 14. An arc-shaped opening 90 is formed in the shell 72 on the back of the body 70 to prevent interference between the post and the shell 72. At the extreme of its pushing stroke, the ejector finger 68 completely pushes a coin out of the hopper 76. At the opposite extreme, the ejector finger 68 swings away from the stack to allow the stack to settle without interference. The ejector finger 68 cannot be thicker than the thickest coin to be sorted and stored for proper separating and feeding of coins from the stack.

The tilt motion mechanism 34 of the preferred illustrated and coin bank is controlled by a switching mechanism 92 comprising a ratchet arm 94, a controller arm 96 and a lifter arm 98. The switching mechanism 92 operates a switch 100 which controls the electric power supply to the motor 58. The switch 100 has two contact blades which, absent any interference, are biased together to close the switch. One of the switch blades includes an extension 102 for engaging a switch cam 104 to open the switch 100. The switch cam 104 is essentially a projection extending from the ratchet arm 94.

Figure 5:
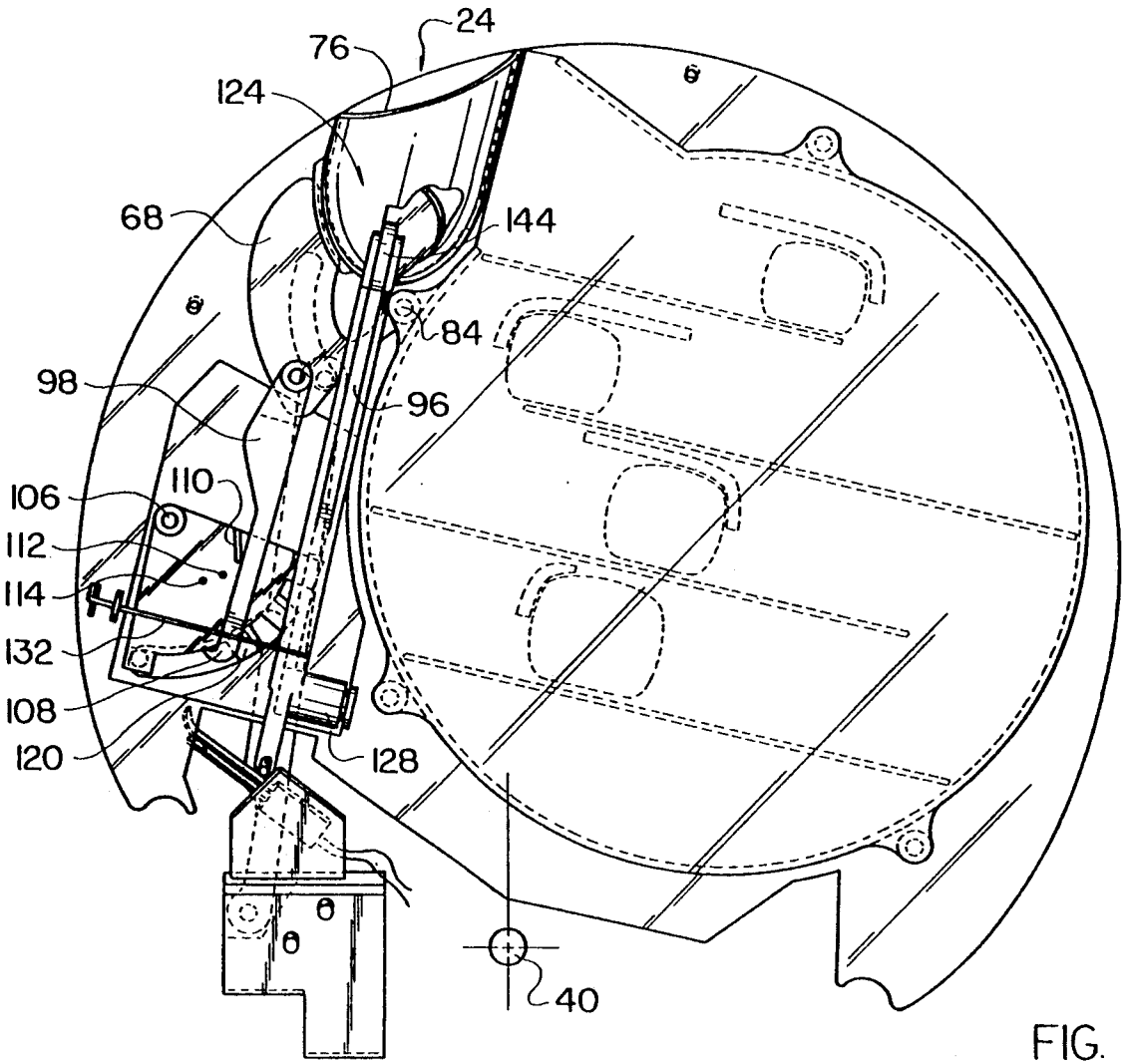
FIG. 5 is the view of FIG. 4 when the coin bank body is tilted in a clockwise direction.
Figure 6:
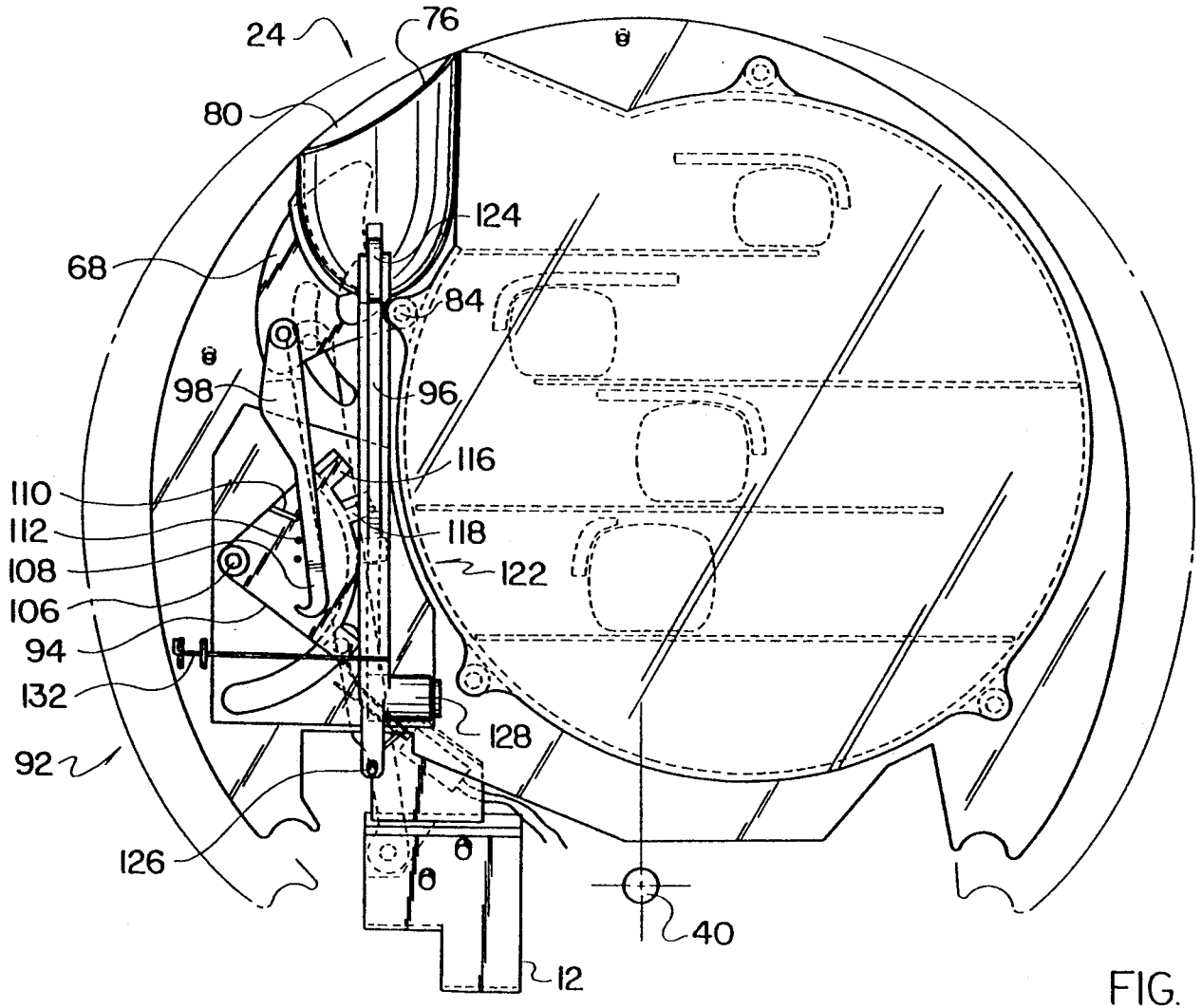
FIG. 6 is the view of FIGS. 4 and 5 when the body is centered.
Figure 7:
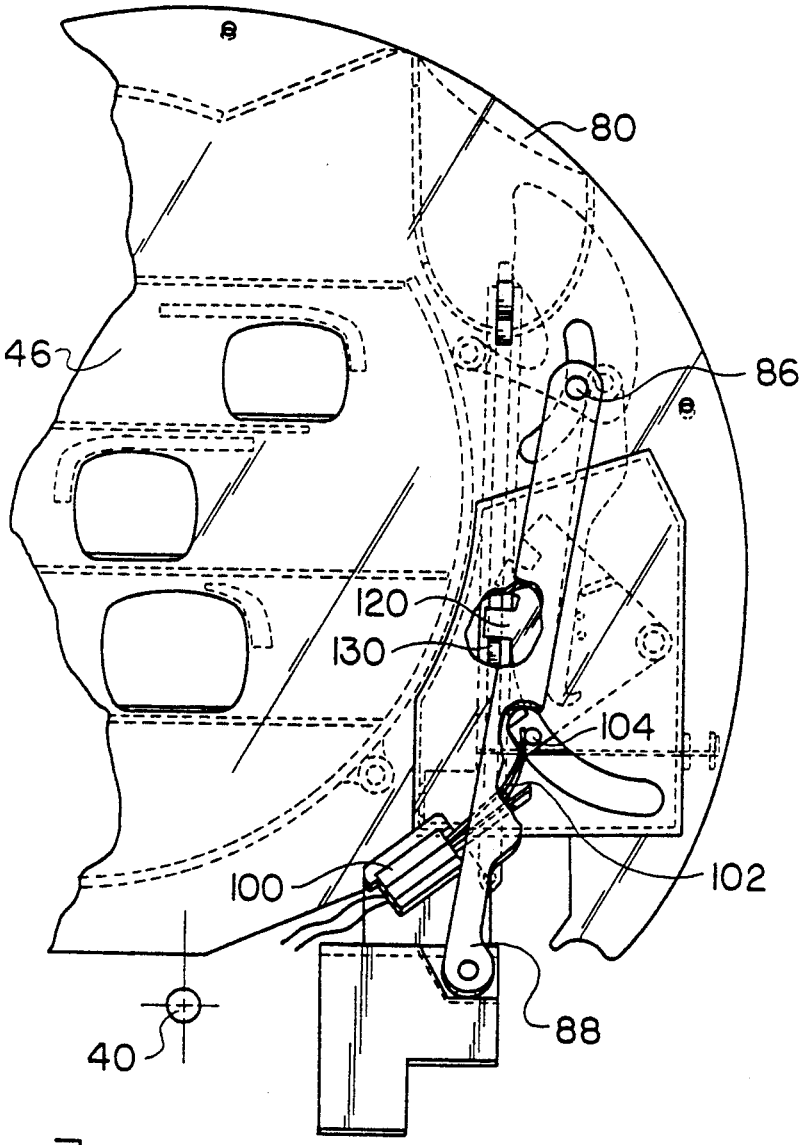
FIG. 7 is a rear view of the coin bank with parts broken away.

The ratchet arm 94 positions the switch cam 104 to open the switch 100 when the body 70 is at the center of its tilt cycle. Thus, the position of the ratchet arm 94 and the position of the body 70 determine the state of the switch 100. The ratchet arm 94 pivots about a ratchet pivot bearing 106 connecting the ratchet arm 94 to the body 70. When the ratchet arm 94 is pivoted upward as illustrated in FIG. 7, and the body 70 is centered, the switch 100 is open and the motor 58 is turned off. When the ratchet arm 94 is pivoted downward as illustrated in FIGS. 5 and 6, the switch 100 is closed and the motor 58 is on regardless of the position of the body 70.

The position of the ratchet arm 94 is affected by the lifter arm 98 and the controller arm 96. The lifter arm 98 is rotatably pinned at its upper end to the ejector finger 68 and hangs therefrom. The lifter arm 98 remains substantially vertical regardless of the position of the body 70 or the ejector finger 68. The lower end of the lifter arm 98 includes a hook 108 for engaging, at various times, each of a plurality of projections 110,112,114 on the ratchet arm. The ratchet arm 94 may hold various positions determined by a plurality of ratchet teeth 116,118,120 formed on the ratchet arm 94. The ratchet teeth 116,118,120 comprise a counting device 122 for counting the number of cycles completed by the tilt motion mechanism 34.

The controller arm 96 comprises a coin sensor 124, a manual release button 126, a controller arm pivot 128 and a pawl 130. The pawl 130 at various times, engages, each of the ratchet teeth 116,118,120. The pawl 130 may be disengaged from the ratchet teeth 116,118,120 by depression of either the manual button 126 or the coin sensor 124. As viewed in the direction of FIGS. 8 and 9, clockwise pivoting of the controller arm 96 either by the presence of a coin in the hopper 76 or by the depression of the button 126 disengages the pawl 130 from the ratchet teeth and allows the ratchet arm 94 to fall to its lowermost position thus disengaging the switch cam 104 from the extension 102 and closing the switch 100. The controller arm 96 is spring biased in the counter-clockwise direction as viewed in FIG. 9 by a cantilever type spring 132 fixed at one end to the body 70 and contacting the controller arm 96 above the controller arm pin 128. Thus, the spring 132 urges the pawl 130 towards the rear of the bank into the path of the ratchet teeth 116,118,120. Depression of the button 126 or the coin sensor 124 operates against this spring force to pivot the controller arm 96.

Whenever the motor 58 is on, the lifter arm 98 reciprocates up and down with respect to the body 70 to draw the hook 108 past the projections 110,112,114. When the ratchet arm is in its lowest position with respect to the body 70, a first projection lies in the path of the hook 108. The hook 108 will engage the first projection 110 on its upward stroke and lift the ratchet arm 94 through a predetermined arc defined by the motion of the ejector finger 68 from which it hangs. This upward motion draws a first ratchet tooth 116 up to the level of the pawl 130. The engagement of the first tooth 116 with the pawl 130 holds the ratchet arm 94 in a position which is above its lowermost position but is not high enough to cause the switch cam 104 to contact the extension 102 at any point in the tilting cycle of the body 70. The new position of the ratchet arm 94 brings a second projection 112 into the path of the hook 108. On its downward stroke, the hook 108 disengages from the first projection 110 and slides downward past the remaining projections in ratchet fashion. On the next upward stroke of the lifter arm 98, the hook 108 engages the second projection 112 and lifts the ratchet arm 94 still higher to a position where a second ratchet tooth 118 engages the pawl 130. The pawl 130 holds the ratchet arm 94 in this higher position. The switch cam 104 is not yet high enough to engage the extension 10 at any point in the tilt cycle of the body 70. The step of lifting the ratchet arm 94 to higher positions in increments continues as a function of the number of projections and the number of ratchet teeth on the arm 94. In the preferred and illustrated embodiment, three projections 110,112,114 and three ratchet teeth 116,118,120 are provided.

Figure 4:
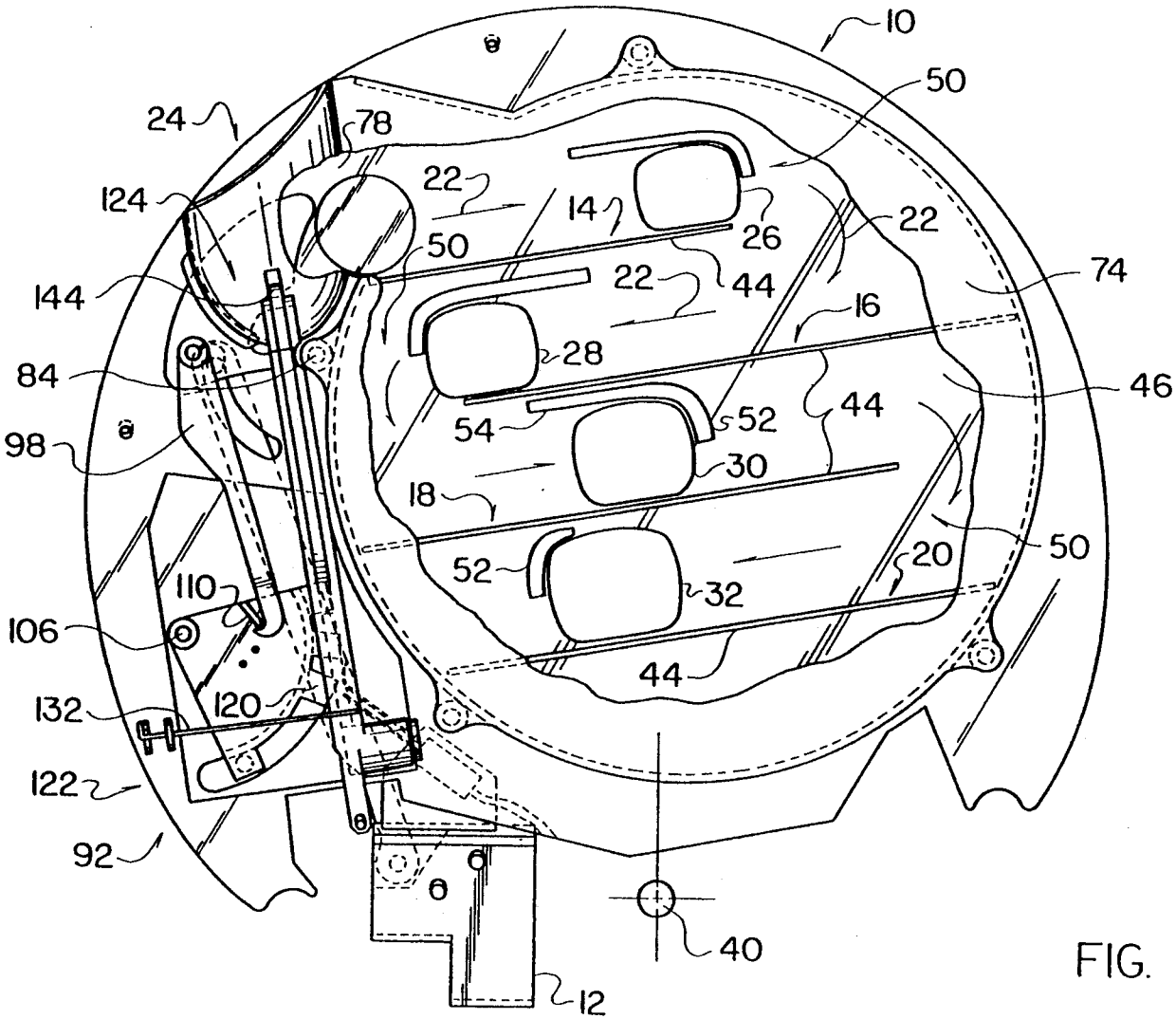
FIG. 4 is a front view of the coin bank with its shell removed and parts broken away when the coin bank body is tilted in a counterclockwise direction.

As viewed from the front of the bank as illustrated in FIG. 4, the hook 108 moves upwardly with respect to the projections 110,112,114 when the body 70 tilts counter-clockwise about the main pivot bearing 40. (Actually, the hook moves only slightly while the tilting of the body 70 causes the ratchet arm 94 to move past the hook 108.) As the body 70 reverses and tilts clockwise towards the center position of the cycle, the hook 108 moves down with respect to the ratchet arm 94. When the final or lowermost projection 114 is engaged by the hook 108, the ratchet arm 94 is brought to its uppermost position with respect to the body 70 and locked into position by the engagement of the third ratchet tooth 120 with the pawl 130. The switch cam 104 does not engage the extension 102 at this point because the body is tilted counter-clockwise (as viewed in the direction of FIG.4) to its furthest extent. When the body 70 reverses and tilts clockwise, the hook 108 moves downward and disengages from the third projection 114 and the switch cam 104 moves upwardly to open the switch 100. The switch 100 is positioned such that the body 70 is halted in the center of its tilting cycle and vertically centered and the channels are horizontal. The hook 108 is below and clear of the projections 110,112,114 when the switch 100 is opened so the ratchet arm 94 may fall without interference when the bank 10 is reactivated.

Depression of the button 126 or placement of a coin in the hopper pivots the controller arm 96 to move the pawl 130 away from and clear of the ratchet teeth 116,118,120. This causes the ratchet arm 94 to fall thus closing the switch 100 and energizing the motor 58. The motor 58 will continue to run until three cycles of the tilt motion mechanism are complete in the absence of any coins in the hopper 76. The last coin is always given time to reach the final aperture 32 along the coin path due to the delay created by the counting device.

The coin sensor 124 is a lever 144 projecting into the lowermost portion of the hopper 76 which detects the presence or absence of coins. The coin sensor 124 is an upper extension of the controller arm 96. A single coin resting on the lever 144 operates to urge the lever in a direction towards the front of the bank, thus pivoting the controller arm 96 in a direction which causes the pawl 130 to disengage from the ratchet teeth 116,118,120. Therefore, none of the ratchet teeth 116,118,120 are engaged by the pawl 130 as long as a coin remains in the hopper 76. The motor 58 will always be energized when coins are in the hopper 76. The absence of a coin is sensed by the lever 144 in its ability to project into the hopper without interference.

The coin storage structure comprises a plurality of coin storage compartments 134,136,138,140. One compartment is provided for each coin size to be sorted and stored. Each compartment includes a catcher 142 for catching coins passing through the corresponding aperture 26,28,30,32. The catchers 142 are positioned directly beneath the sorting apertures 26,28,30,32 such that coins fall under the influence of gravity through the apertures 26,28,30,32 and onto the catchers 142 and are guided by the catcher into one of the compartments 134,136,138,140. Thus, only coins of a predetermined size are deposited and stored in any one compartment 134,136,138,140.

The foregoing is considered as illustrative of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

I claim:

1. A coin bank for sorting and storing coins of varying diameters, said coin bank comprising:

a plurality of coin supporting channels forming a coin path, said path having an upstream end and a downstream end, a coin receiver located at said upstream end for receiving said coins, said receiver communicating with a first of said channels, a plurality of apertures of varying size, each being sized to permit passage of only coins having a diameter less than or equal to a predetermined diameter, said apertures being located in at least one of said channels, wherein except for the first aperture, each aperture is larger in size than its neighboring upstream aperture such that smaller coins are sorted from the path before larger coins, a tilt motion mechanism operable to tilt said channels in a continuous rocking motion such that said channels are alternately inclined in one direction and then inclined in the opposite direction, said rocking motion causing a coin present in said receiver to roll on edge along said path from said first channel to successive downstream channels, and coin storage structure located to catch coins permitted to pass through said apertures.

2. A coin bank according to claim 1 wherein said coin receiver includes an ejector finger operable to reciprocate with respect to said receiver to urge a coin towards said first channel.

3. A coin bank according to claim 1 wherein said receiver includes sensing means for sensing the presence of a coin and operating to control said tilt motion mechanism.

4. A coin bank for sorting and storing coins of varying diameters, said coin bank comprising:

a plurality of coin supporting channels forming a coin path, said path having an upstream end and a downstream end;

a coin receiver located at said upstream end for receiving said coins, said receiver communicating with a first of said channels;

a plurality of apertures of varying size, each being sized to permit passage of only coins having a diameter less than or equal to a predetermined diameter, said apertures being located in at least one of said channels;

a tilt motion mechanism operable to tilt said channels in a continuous rocking motion such that said channels are alternately inclined in one direction and then inclined in the opposite direction, said rocking motion causing a coin present in said receiver to roll on edge along said path from said first channel to successive downstream channels;

coin storage structure located to catch coins permitted to pass through said apertures; and wherein said ejector finger is connected to said tilt motion mechanism to reciprocate in synchronism with said tilting of said channels.

5. A coin bank for sorting and storing coins comprising a base, a body, a coin storage structure, and a tilt motion mechanism, said coin storage structure comprising a plurality of coin receiving compartments, each said compartment being arranged to receive coins of a predetermined size; said body comprising:

an upright sorter wall means, said sorter wall means comprising a plurality of apertures, each said aperture having a predetermined size to permit passage of coins having a particular size through said sorter wall means into said coin storage structure;

a plurality of vertically spaced coin ramps positioned adjacent to said sorter wall means, said coin ramps and said sorter wall means defining a coin path having an upstream direction and a downstream direction, each of said coin ramps having an upper coin supporting surface for supporting coins on edge, at least a first of said ramps terminating at a downstream end at a passage such that coins may drop from said first ramp to a second lower ramp;

a coin receiver for receiving and guiding coins towards said first coin ramp;

wherein said apertures are located along said path and said tilt motion mechanism operates to tilt said coin ramps with respect to said base to cause any coins present on said path to roll in said downstream direction.

6. A coin bank according to claim 5 wherein said coin sorter wall means forms channels with each of said ramps such that at least a portion of a face of a coin rolling along said path contacts said sorter wall means until said coin reaches one of said apertures which is sized greater than said coin.

7. A coin bank according to claim 5 wherein said ramps project from and are integral with said sorter wall means and said tilt motion mechanism tilts said sorter wall means with respect to said base to cause any coins present on said path to roll in said downstream direction.

8. A coin bank according to claim 5 wherein said path is serpentine and said ramps are tilted by said tilt motion mechanism such that coins present on said second ramp travel in a direction substantially opposite to a direction traveled by coins present on said first ramp.

9. A coin bank according to claim 5 wherein said coin receiver is a hopper having an ejector finger, said ejector finger being operable to reciprocate with respect to said hopper to separate and transport from said hopper a single coin to said first coin ramp per reciprocation.

10. A coin bank according to claim 9 wherein said ejector finger is connected to said tilt motion mechanism to reciprocate with respect to said hopper in synchronism with said tilt of said ramps.

11. A coin bank according to claim 9 wherein a portion of said sorter wall means forms one side of said hopper.

12. A coin bank according to claim 5 wherein said coin receiver includes sensing means for sensing the presence of a coin, said sensing means operating to control said tilt motion mechanism.

13. A coin bank according to claim 12 wherein said tilt motion mechanism is powered by electricity and said sensing means forms part of an switching mechanism which controls the power supply to said tilt motion mechanism.

14. A coin bank according to claim 13 wherein said switching mechanism operates to turn off power to said tilt motion mechanism after a predetermined time as elapsed from a time when the absence of a coin is sensed by said sensing means.

15. A coin bank according to claim 14 wherein said switching mechanism includes a counting mechanism for counting the number of tilt motions produced by said tilt motion mechanism, and said predetermined time is determined by said counting mechanism.

16. A coin bank according to claim 5 wherein said sorter wall means is transparent.

17. A coin bank according to claim 5 wherein said sorter wall means includes coin stop means extending into said path adjacent said apertures which engage and stop selected ones of passing coins which are smaller than a predetermined size to facilitate passage of said selected ones through said apertures.

18. A coin bank according to claim 17 wherein said sorter wall means includes cam means extending into said path adjacent said apertures, said cam means being operable to urge said passing coins away from said stop means if said passing coins are greater than a predetermined size.

19. A coin bank according to claim 5 wherein said tilt motion mechanism operates to oscillate said body about a pivot between said base and said body.

20. A coin bank for storing coins and for providing an entertaining visual display comprising:

i) a coin storage structure;

ii) a body comprising:

a display area;

a coin receiver;

a plurality of discrete vertically spaced coin ramps located in said display area, each having an upstream end and a downstream end;

a plurality of vertical passageways joining the downstream ends of some of said ramps to the upstream ends of others of said ramps, wherein said ramps and said vertical passageways define a coin path; and, at least one aperture through which coins may fall passing from one of said ramps to said coin storage structure;

iii) a tilt motion mechanism connected to said body for tilting said body from side to side to cause coins to roll on edge along said ramps and to fall through said vertical passageways providing said display and then to fall to said coin storage structure.

* * * * *